United States Patent [19]

Quirk

[11] 4,109,667

[45] Aug. 29, 1978

[54] HAIR SETTING ROLLER

[75] Inventor: Virgil P. Quirk, St. Marys, Pa.

[73] Assignee: Stackpole Carbon Company, St. Marys, Pa.

[21] Appl. No.: 739,550

[22] Filed: Nov. 8, 1976

[51] Int. Cl.[2] ..... A45D 2/12

[52] U.S. Cl. ..... 132/33 R; 219/222

[58] Field of Search ..... 132/33 R, 40, 42, 9; 219/222

[56] References Cited

U.S. PATENT DOCUMENTS

| | | | |
|---|---|---|---|
| 116,731 | 7/1871 | Marcy | 132/33 R |
| 3,209,766 | 10/1965 | Dannat | 132/40 |
| 3,250,895 | 5/1966 | McNair | 132/33 R |
| 3,417,760 | 12/1968 | Silver | 132/40 |
| 3,488,471 | 1/1970 | Gstalder | 132/33 R |
| 3,665,939 | 5/1972 | Laing | 132/33 R |
| 3,760,148 | 9/1973 | Boudouris | 132/33 R |
| 3,881,086 | 4/1975 | Fleischhauer | 132/33 R |
| 3,911,935 | 10/1975 | Wallin | 132/33 R |

*Primary Examiner*—Louis G. Mancene
*Assistant Examiner*—Gregory E. McNeill
*Attorney, Agent, or Firm*—Brown, Murray, Flick & Peckham

[57] ABSTRACT

A hair setting roller includes a dielectric cylinder encircled by an electrical resistance magnetic heating element secured to it and adapted to be attracted by a permanent magnet mounted in apparatus having a pair of laterally spaced electric supply contacts. Electrically connected to the opposite ends of the heating element are electric contacts for engaging the supply contacts while the magnet overcomes a force tending to separate the roller and magnet, whereby to heat the heating element electrically. The heating element has a magnetic permeability that decreases as its temperature increases until the attraction of the magnet for the device becomes weaker than the separating force acting on the roller.

8 Claims, 5 Drawing Figures

HAIR SETTING ROLLER

U.S. Pat. No. 3,559,658 shows hair setting apparatus provided with a pair of laterally spaced electric supply contacts connected to wires adapted to be plugged into an electrical outlet. Between the contacts there is a permanent magnet. The apparatus has surfaces inclined downwardly away from the contacts for supporting a hair setting roller. This roller includes a cylinder made from a ferrous alloy that has a predetermined curie point. Coiled around the cylinder but insulated from it is an electric heating coil, the ends of which are connected to contacts that will engage the supply contacts when the roller is held in heating position by the attraction of the magnet for the alloy. The heating coil is encircled, engaged and concealed by a plastic shell, around which a woman can wrap strands of her hair to curl it. As the heating coil raises the temperature of the shell and the alloy inside of the coil, the magnetic permeability of the alloy decreases until the attraction between the alloy and the magnet is no longer sufficient to hold the roller in heating position. The roller then rolls down away from the supply contacts and is ready for use. This separation of the roller from the supply contacts is designed to occur at a temperature that will result in the roller having the proper temperature for hair setting.

Since in the patented construction the heating coil and the ferrous alloy magnetic element are separate parts of a hair roller, assembly problems occur. Also, problems of electrical insulation between the coil and alloy arise at the operating temperature. Because the heating coil and the magnetic element are separated, thermal coupling is a variable, which is undesirable. The direct engagement of the heating coil with the plastic shell limits the temperature to which the coil can be raised, because if the temperature is too high, the shell may be melted.

It is among the objects of this invention to provide improved hair setting apparatus of the general type shown in the above patent, in which the roller is simpler in construction, easier to make, easier to assemble, less expensive, more quickly heated, more consistent in its temperature and safer to use.

The preferred embodiment of the invention is illustrated in the accompanying drawings, in which FIG. 1 is a plan view of the apparatus, partly broken away in horizontal section;

Figure 2:
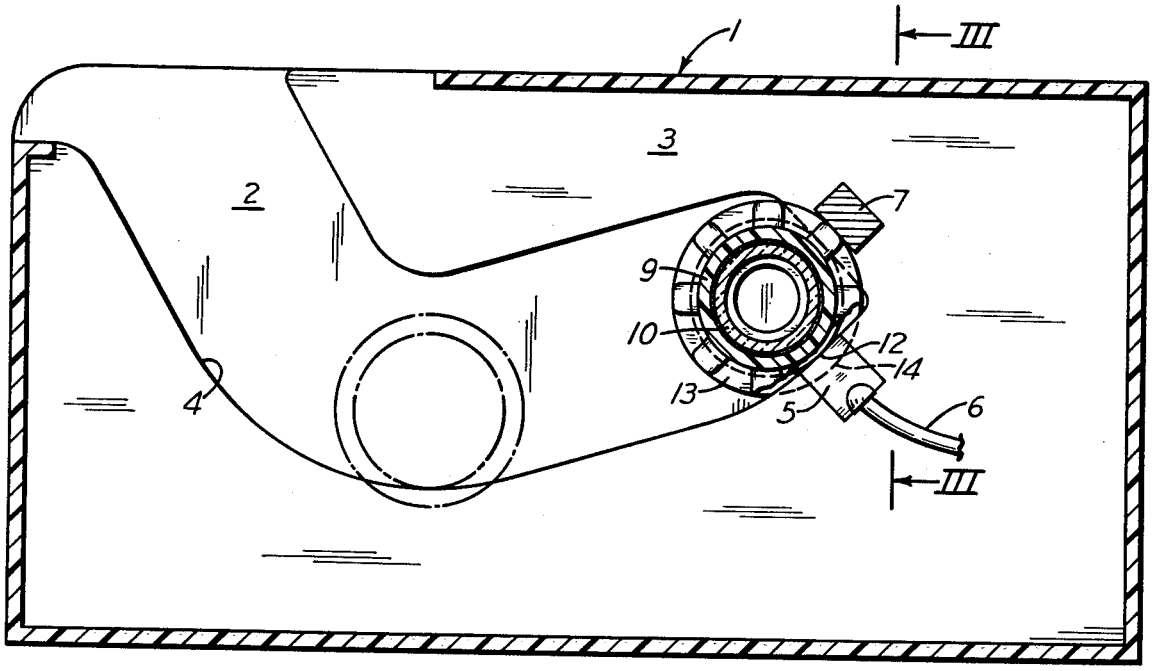
FIG. 2 is a vertical section taken on the line II—II of FIG. 1.
Figure 1:
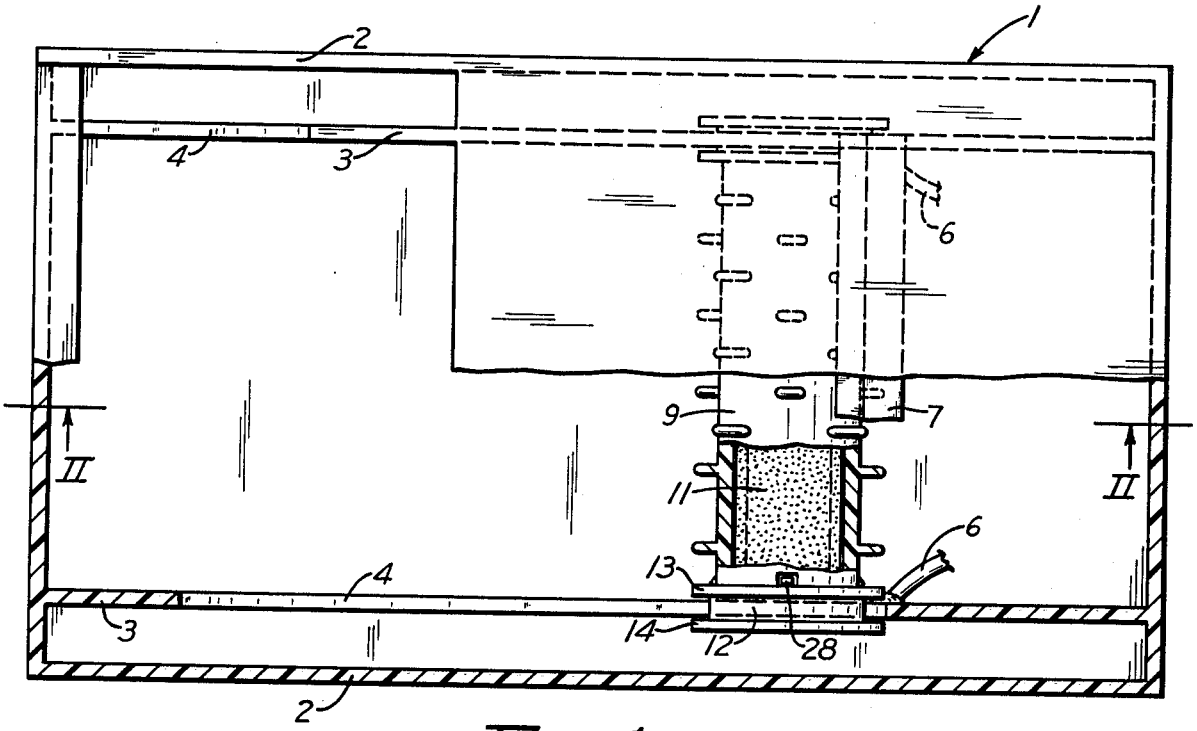
Figure 3:
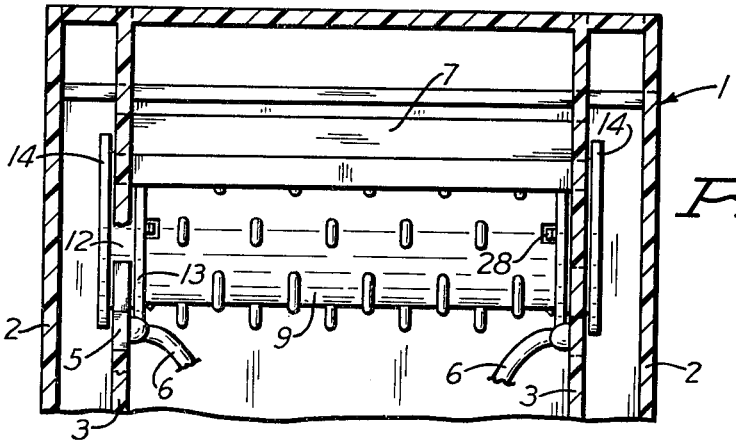
FIG. 3 is a fragmentary vertical section taken on the line III—III of FIG. 2.

Referring to FIGS. 1 to 3 of the drawings, a box-like stand 1, preferably molded from a plastic, has outer and inner side walls 2 and 3. The inner walls are provided with parallel dog leg slots 4 that slope downwardly from near the front end of the stand where its top is open. The slots slope toward the rear end of the stand a short distance and then are inclined upwardly at a lesser angle beneath the top of the stand. Molded in the inner side walls of the stand at the rear ends of the slots is a pair of laterally spaced electric supply contacts 5 that are connected by wires 6 to an electric plug (not shown) that can be plugged into a conventional electrical outlet in a house or beauty parlor. Between, and somewhat behind, the contacts a permanent magnet 7 is rigidly mounted, such as by molding its ends in the inner side walls of the stand, or by any other suitable means.

A hair roller can roll along the inclined lower walls of the stand slots. This roller, like the one shown in the abovementioned patent, is designed to be electrically heated by making electrical contact with the supply contacts 5 while the roller is held in heating position at the rear or inner ends of the slots by means of the magnetic attraction of the permanent magnet for it. When the temperature of the roller reaches a certain point, which has been predetermined, the roller automatically rolls forward away from the supply contacts and is ready for use. It can be lifted out of the outer ends of the slots.

In accordance with this invention, the hairsetting roller includes a cylindrical shell 9 of a suitable plastic that encircles a dielectric cylinder 10, preferably a glass tube. "Dielectric cylinder" as used herein also includes a nonmagnetic metal cylinder coated on its outside with an insulating material, or wrapped in insulation. The glass tube is longer than the plastic shell and projects from its opposite ends. Encircling the tube between it and the shell is an electrical resistance magnetic heating element 11 that is secured to the tube, with the shell spaced from the heating element. The magnetic heating element is attracted magnetically by permanent magnet 7 when the roller is at the inner end of the stand slots, whereby the roller is held in that position temporarily as shown in FIG. 2. The opposite ends of the magnetic heating element are electrically connected to exposed cylindrical electric contact bands 12 which, when the roller is close to the magnet, will engage supply contacts 5 so that electric current will flow through the heating element and heat it to raise its temperature and thereby the temperature of the plastic shell. The roller need not touch the magnet. Each contact band 12 is located between a pair of end flanges 13 and 14 on the roller and is electrically connected with the heating member in the manner that will be described in connection with FIG. 5.

It is a feature of this invention that the magnetic heating element is formed from a material that has a curie point at which it loses substantially all of its magnetic permeability. One such material is a soft ferrite, a layer or coating of which can be applied to the outside of the glass tube in any well-known manner, such as by spraying. Nickel-zinc ferrite, magnesium-zinc ferrite and copper-magnesium-zinc ferrite are examples of some of the soft ferrites that can be used.

Figure 5:
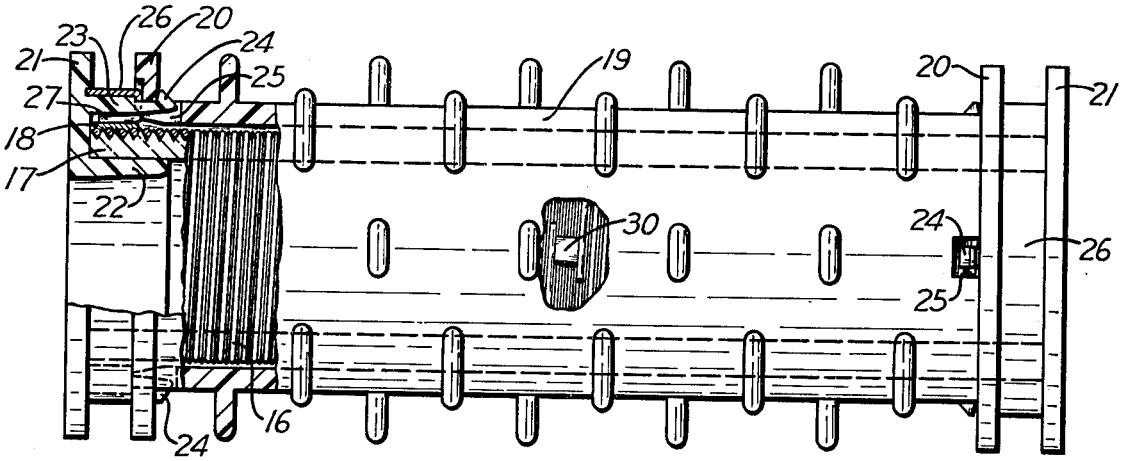
FIG. 5 is an enlarged side view, partly broken away in section, of a modified roller.

Another way of forming the magnetic heating element is shown in FIG. 5, where a coil 16 of ferrous alloy wire, such as 52 nickel magnetic ferrous wire, is wound around a glass tube 17. The coil, which has a curie point, can be held in place on the tube by electric contacts 18 formed by spraying a narrow band of metal around each end of the tube in overlapping engagement with the ends of the wire. Another way of anchoring the coil is to resistance heat the end portions of the wire electrically sufficiently to soften the adjoining areas of the glass so that the ends of the wire can be pressed into the glass. Then end contact bands are formed over the end convolutions of the coil. The end contacts 18 project from the opposite ends of an encircling shell 19 of plastic, which is provided with end flanges 20. Rigidly mounted on the ends of the glass tube are flange members 21 that are spaced from the shell flanges. These flange members have cylindrical portions 22 that fit snugly in the ends of the tube. Flange members 21 and flanges 20 correspond to flanges 14 and 13 in FIG. 1.

Each flange member 21 also has a ring portion 23 encircling the tube end and spaced from it. The ring portion spans the space between the flange member and the adjacent shell flange 20. Projecting laterally from each ring portion 23 are several circumferentially spaced spring prongs 24 that extend through slots 25 in the shell flange and the shell itself. The free ends of these prongs are shaped to engage the inner surface of the shell flange to attach the flange member to it and to hold the shell away from the heating element. The ring portion 23 is encircled by a metal contact band 26 provided with circumferentially spaced lugs 27 that extend radially inward between the spring prongs and have bent inner ends pressing against contact 18. These contact bands 26, which correspond to contact bands 12 in FIG. 1, roll on the lower walls of the stand slots and engage the supply contacts when the roller is in heating position. The four flanges of the roller serve as guides to hold the roller in place in the slots.

Flanges 14 in FIG. 1 are held in place by spring prongs 28 in the same way as flange members 21 in FIG. 5. Also, contact bands 12 are electrically connected in the manner shown in FIG. 5 to sprayed-on contacts (not shown) engaging the ends of the ferrite coating in FIG. 1.

A safety feature is illustrated in FIG. 5, in which the wire coil 16 is divided into two parts connected midway between the ends of the roller by a fusible link 30. If something went wrong with the apparatus and the roller started to overheat, the link would melt and break the circuit through the heating element.

Figure 4:
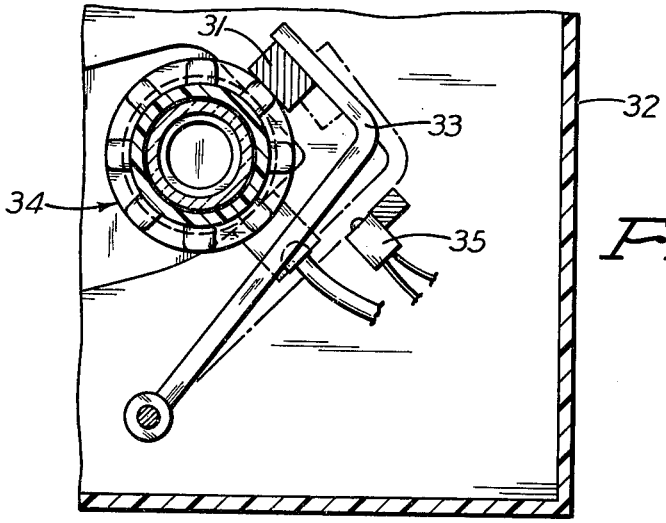
FIG. 4 is a fragmentary vertical section of a modification.

The roller, whether provided with a ferrite coating or a wire coil, is designed so that the curie point of the heating element is not reached in use. At some desirable temperature below the curie point, called herein the cross-over temperature, a combination of reduction in magnetic permeability due to an increase in temperature, and a force tending to separate the roller from the magnet, will result in the roller being released from the magnet and it will roll away from the supply contacts. Usually, the separating force will be simply gravity, the effect of which will depend upon the weight of the roller and the inclination of the lower walls of the stand slots 4. However, gravity can be aided, or replaced by a spring pressing the roller in a direction away from the supply contacts. Or, as shown in FIG. 4, the permanent magnet 31 can be mounted in the stand 32 on a pivoted arm 33 and be urged away from the hair setting roller 34 by a spring or by gravity. In any event, when the cross-over temperature is reached, the hair setting roller separates from the supply contacts and is then ready for use. An advantage in having the magnet fall away from the roller is that it can be made to open a microswitch 35 in the circuit feeding the supply contacts, so even if the roller does not move away from those contacts the circuit will be broken and overheating prevented. Of course, the magnet must remain close enough to a roller at the inner ends of the slots to permit the magnet to be swung back toward a cool roller by the magnetic attraction between them.

It will be seen that by combining the heating element and the magnetic element of the roller into a single element, the construction of the roller is simplified and its cost reduced. There is no problem in insulating a heating element from a magnetic element because they are one and the same. For the same reason the problem of thermal coupling is eliminated. The spacing of the plastic shell from the heating element allows the latter to be raised to a higher temperature than would be the case if the shell engaged the heating element.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In a hair setting roller for use with apparatus having a pair of laterally spaced electric supply contacts and a permanent magnet between them, a dielectric cylinder, an electrical resistance magnetic heating element encircling the cylinder and secured thereto and adapted to be attracted by said magnet, and circular electric contacts electrically connected to the ends of said element, said contacts encircling the opposite ends of said cylinder in spaced relation with said element for engaging said supply contacts while said magnet overcomes a force tending to separate said roller and magnet, whereby to heat said element electrically, said resistance heating element having a magnetic permeability that decreases as its temperature increases until the attraction of the magnet and said element for each other becomes weaker than said separating force acting on the roller.

2. In a hair setting roller according to claim 1, said separating force being a spring.

3. In a hair setting roller according to claim 1, said magnetic heating element being a ceramic magnetic ferrite coating encircling said cylinder.

4. In a hair setting roller according to claim 1, said magnetic heating element being a coil of magnetic resistance wire encircling said cylinder in engagement therewith.

5. In a hair setting roller according to claim 4, sprayed-on contact material encircling said cylinder and anchoring the ends of said coil of wire to the cylinder, and means electrically connecting said material to said circular contacts.

6. In a hair setting roller according to claim 4, said cylinder being glass, and the end portions of said wire being fused into said glass to hold said coil in place on the cylinder.

7. In a hair setting roller according to claim 1, electric contact material around the ends of said cylinder in engagement with said magnetic heating element, a hollow dielectric shell encircling said heating element and spaced therefrom, and means electrically connecting said material to said circular contacts.

8. In a hair setting roller according to claim 7, a pair of laterally spaced radial flanges rigidly mounted at each end of said shell, each of said circular contacts being disposed between a pair of said flanges.

* * * * *